US009761964B2

(12) United States Patent
Meyer

(10) Patent No.: US 9,761,964 B2
(45) Date of Patent: Sep. 12, 2017

(54) CONNECTION TERMINAL AND SPRING-LOADED TERMINAL CONTACT THEREFOR

(71) Applicant: WAGO Verwaltungsgesellschaft mbH, Minden (DE)

(72) Inventor: Michael Meyer, Wiedensahl (DE)

(73) Assignee: WAGO VERWALTUNGSGESELLSCHAFT MBH, Minden (DE)

( * ) Notice: Subject to any disclaimer, the term of this patent is extended or adjusted under 35 U.S.C. 154(b) by 0 days.

(21) Appl. No.: 15/117,347

(22) PCT Filed: Feb. 26, 2015

(86) PCT No.: PCT/EP2015/053998
§ 371 (c)(1),
(2) Date: Aug. 8, 2016

(87) PCT Pub. No.: WO2015/128407
PCT Pub. Date: Sep. 30, 2015

(65) Prior Publication Data

US 2016/0352028 A1 Dec. 1, 2016

(30) Foreign Application Priority Data

Feb. 26, 2014 (DE) ..... 10 2014 102 517

(51) Int. Cl.
*H01R 9/24* (2006.01)
*H01R 4/48* (2006.01)
(Continued)

(52) U.S. Cl.
CPC ..... *H01R 9/2416* (2013.01); *H01R 4/4818* (2013.01); *H01R 4/4836* (2013.01);
(Continued)

(58) Field of Classification Search
CPC ..... H01R 4/4818; H01R 4/48; H01R 12/85; H01R 4/4845; H01R 4/4836;
(Continued)

(56) References Cited

U.S. PATENT DOCUMENTS 4,397,514 A 8/1983 Durand et al.
5,915,991 A * 6/1999 Roman ..... H01R 4/4827 439/441
(Continued)

FOREIGN PATENT DOCUMENTS

DE 20211513 U1 11/2003
DE 19654611 B4 9/2004
(Continued)

OTHER PUBLICATIONS

Machine Translation of EP 0037758 A1, dated Oct. 1981.*
(Continued)

*Primary Examiner* — Tulsidas C Patel
*Assistant Examiner* — Travis Chambers
(74) *Attorney, Agent, or Firm* — Renner, Otto, Boisselle & Sklar, LLP

(57) ABSTRACT

A spring-loaded terminal contact (3) for contacting electrical conductors having at least one busbar (7) and having at least one clamping spring (9) which has an abutment member (10), a clamping member (12) and a curved resilient member (11) which is arranged between the abutment member (10) and the clamping member (12) is described. The clamping member (12) extends in the direction toward the busbar (7) and has a resilient clamping edge (8) for clamping an electrical conductor which is introduced between the clamping member (12) and the busbar (7) in a conductor insertion direction (L). The busbar (7) has a clamping edge (6) which together with the resilient clamping edge (8) forms a clamping location for the electrical conductor which is intended to
(Continued)

be clamped. The busbar (7) has a groove-like recess (14) in the conductor insertion direction (L) upstream of the clamping location adjacent to the clamping edge (6).

10 Claims, 4 Drawing Sheets

(51) Int. Cl.
*H01R 11/09* (2006.01)
*H01R 101/00* (2006.01)

(52) U.S. Cl.
CPC ..... *H01R 11/09* (2013.01); *H01R 9/24* (2013.01); *H01R 2101/00* (2013.01)

(58) Field of Classification Search
CPC .. H01R 9/2416; H01R 11/09; H01R 2101/00; H01R 9/24; H01R 4/4881
USPC ..... 439/709, 439, 441, 635, 729, 834, 835
See application file for complete search history.

(56) References Cited

U.S. PATENT DOCUMENTS

| | | | | |
|---|---|---|---|---|
| 6,261,120 | B1 * | 7/2001 | Beege | H01R 4/4836 439/268 |
| 6,832,938 | B2 * | 12/2004 | Lenker | H01R 4/4836 439/441 |
| 7,255,592 | B1 * | 8/2007 | Tseng | H01R 4/22 439/439 |
| 7,507,106 | B2 | 3/2009 | Keswani et al. | |
| 7,785,134 | B2 * | 8/2010 | Dhandapani | H01R 4/4818 439/441 |
| 8,052,462 | B2 | 11/2011 | King, Jr. et al. | |
| 8,062,077 | B2 * | 11/2011 | Hayashi | H01R 4/4863 439/725 |
| 8,262,422 | B1 * | 9/2012 | Chiang | H01R 4/4836 439/441 |
| 8,388,387 | B2 | 3/2013 | Koellmann | |
| 8,444,443 | B2 * | 5/2013 | Schafmeister | H01R 4/4836 439/441 |
| 8,794,994 | B2 * | 8/2014 | Kollmann | H01R 4/4836 439/441 |
| 9,437,940 | B1 * | 9/2016 | Rao | H01R 4/4836 |
| 2012/0264339 | A1 * | 10/2012 | Brand | H01R 4/4827 439/733.1 |
| 2015/0372402 | A1 | 12/2015 | Köllmann et al. | |
| 2015/0380838 | A1 | 12/2015 | Kollmann et al. | |

FOREIGN PATENT DOCUMENTS

| | | | |
|---|---|---|---|
| DE | 102008028575 | A1 | 12/2008 |
| DE | 102010024809 | A1 | 12/2011 |
| DE | 202013100635 | U1 | 3/2013 |
| DE | 102013101410 | A1 | 8/2014 |
| EP | 0037758 | A1 | 10/1981 |
| EP | 0616386 | A2 | 9/1994 |
| WO | 2008/095453 | A1 | 8/2008 |

OTHER PUBLICATIONS

International Search Report and Written Opinion of the International Search Authority for corresponding patent application No. PCT/EP2015/053998 dated May 25, 2015.
International Preliminary Report on Patentability for corresponding International Application No. PCT/EP2015/053998 dated Aug. 30, 2016.

* cited by examiner

CONNECTION TERMINAL AND SPRING-LOADED TERMINAL CONTACT THEREFOR

This application is a national phase of International Application No. PCT/EP2015/053998 filed Feb. 26, 2015 and published in the English language.

The invention relates to a spring-loaded terminal contact for contacting electrical conductors having at least one busbar and having at least one clamping spring which has an abutment member, a clamping member and a curved resilient member which is arranged between the abutment member and the clamping member, wherein the clamping member extends in the direction toward the busbar and has a resilient clamping edge for clamping an electrical conductor which is introduced between the clamping member and the busbar in a conductor insertion direction, and wherein the busbar has a clamping edge which together with the clamping edge forms a clamping location for the electrical conductor which is intended to be clamped.

The invention further relates to a connection terminal for electrical conductors having an insulating material housing which has at least one conductor introduction opening for introducing an electrical conductor. In this instance, at least one spring-loaded terminal contact is integrated in the insulating material housing.

Such spring-loaded terminal contacts are used for clamping electrical conductors using the force of the clamping spring in various manners, for example, in socket terminals for electrically conductive connection of a plurality of electrical conductors to each other, in plug type connectors, such as, for example, printed circuit board plug type connectors, device plug type connectors, device connection adapters, series terminals or other electrical devices.

DE 102 37 701 B4 describes a lever-actuated connection terminal in which a cage tension spring is positioned with the abutment member thereof on a busbar piece. The busbar piece protrudes through a conductor through-opening of the cage tension spring. The busbar piece is bent with a clamping edge being formed for an electrical conductor which is intended to be clamped in the region of contact tongues on which the abutment member of the clamping spring is positioned.

DE 196 54 611 B4 discloses a connection terminal with a leaf spring which is bent in a U-shaped manner (also referred to as a leg spring) and which is suspended in a conductor through-opening of a busbar piece. The busbar piece is folded over in such a manner that it has a retention member and a contact member which together form a corner angle. The contact member has for forming a clamping edge two inclined faces which taper toward each other.

DE 10 2010 024 809 A1 describes a lever-actuated connection terminal with an insulating material housing and a resilient clamping unit with a clamping spring and a busbar portion. In the clamping region of the busbar, there are provided protuberances of a busbar which face in the direction of the free end of the clamping spring and the opposing abutment member. The region of the busbar which is located in the conductor insertion direction upstream of the clamping location is inclined in order to form an inclined introduction member for an electrical conductor relative to the busbar plane.

DE 20 2013 100 635 U1 discloses a spring terminal contact for contacting electrical conductors having a busbar and having at least two clamping springs which are suspended in frame portions which extend away from the busbar. The frame portions are arranged spaced apart from each other with an intermediate space being formed. A clamping edge which extends transversely relative to the conductor insertion direction is provided on the busbar.

Based on this, an object of the present invention is to provide an improved spring-loaded terminal contact and an improved connection terminal in which the electrical connection of an electrical conductor which is clamped to the busbar under the force of the clamping spring is improved.

The object is achieved with the spring-loaded terminal contact having the features of claim 1 and by the connection terminal having the features of claim 9.

Advantageous embodiments are described in the dependent claims.

For a spring-loaded terminal contact of the generic type, it is proposed that the busbar have a groove-like recess in the conductor insertion direction upstream of the clamping location adjacent to the clamping edge.

Whilst previous busbars are inclined only in the conductor insertion direction upstream of the clamping location or upstream of the clamping edge of the busbar in order to expose the clamping edge, it is now proposed that a groove-like recess be provided upstream of the clamping location.

From an electrical point of view, such a groove-like recess results in the free end of an electrical conductor from which insulation has been removed not being positioned in a linear or planar manner on the busbar in the region adjacent to the clamping edge of the busbar. Instead, as a result of the groove-like recess, a spacing is produced between the free end of the electrical conductor to be clamped and the busbar. The clamping force of the clamping spring is consequently concentrated on the contact edge, which increases the surface pressure. A current which is flowing through the electrical conductor is consequently guided through the clamping edge in a concentrated manner. The transition resistances are thereby reduced in comparison with an additional planar abutment of the electrical conductor on the busbar.

In addition, it is possible with the groove-like recess to provide improved guiding for the free end of the electrical conductor which is intended to be clamped. As a result of the groove-like recess, a connection terminal having an insulating material housing which has at least one conductor introduction opening for introducing an electrical conductor and such a spring-loaded terminal contact which is integrated in the insulating material housing can be constructed to be even more compact than in a variant with a significantly inclined busbar.

It is particularly advantageous for the groove-like recess to be stamped in the busbar. The groove-like recess can consequently be produced during the production operation with a simple shaping process.

In this instance, the groove-like recess can either be coined or embossed. During the coining operation, the material of the busbar is compressed in the region of the groove-like recess with the surface of the busbar located therebelow being retained. The bead which is stamped consequently does not lead to an increase of the cross-section of the busbar with a coining operation.

However, it is particularly advantageous for the groove-like recess (bead) to be embossed. In this instance, as a result of the stamping of the bead, excess material moves out of the lower plane of the busbar with a protuberance being formed. These protuberances can be used for stable support of the busbar in the insulating material housing. In addition, the flow cross-section of the busbar remains almost unchanged during the embossing operation.

In a preferred embodiment, there is arranged in the conductor insertion direction downstream of the clamping location or downstream of the clamping edge of the busbar a retention flap which extends away from the busbar plane. The clamping spring which is constructed as a leg spring is in this instance suspended in the retention flap with the abutment member thereof with spacing from the busbar plane. This enables a particularly stable, self-supporting and compact construction shape of the spring-loaded terminal contact.

The retention flap may be constructed integrally with the busbar by the retention flap being bent away from the busbar plane during the production of the busbar. However, it is also conceivable for the retention flap to be constructed as a component which is separate from the busbar. The retention flap may in this instance be frame-like and be suspended in a material flap of the busbar. However, it may also be suspended in an aperture recess of the busbar by the retention flap having a protruding material flap.

It is particularly advantageous for the busbar to extend transversely relative to the conductor insertion direction and for a plurality of groove-like recesses which extend parallel with each other to be arranged beside each other on the busbar. A clamping spring is then associated with each groove-like recess. With such a spring-loaded terminal contact, in which a plurality of clamping springs which are arranged in a sequential direction beside each other divide a busbar, it is possible to produce a particularly compact socket terminal which using the groove-like recesses enables improved connection of the electrical conductor to the busbar.

With such a spring-loaded terminal contact, a retention flap may be provided for each clamping spring, wherein the retention flaps are arranged spaced apart from each other with an intermediate space being formed. Such an arrangement of retention flaps with an intermediate space being formed has the advantage that an actuation member can be integrated in the intermediate space in a space-saving manner.

In this regard, in a particularly advantageous connection terminal at least one pivotably supported actuation lever is integrated in the insulating material housing. The actuation lever has in this instance an actuation portion which cooperates with the clamping member of at least one associated clamping spring in order to open the clamping location when the actuation lever is pivoted.

In this instance, the actuation lever is preferably adjacent to the groove-like recess.

The invention is explained in greater detail below with reference to an embodiment with the appended drawings, in which.

Figure 1:
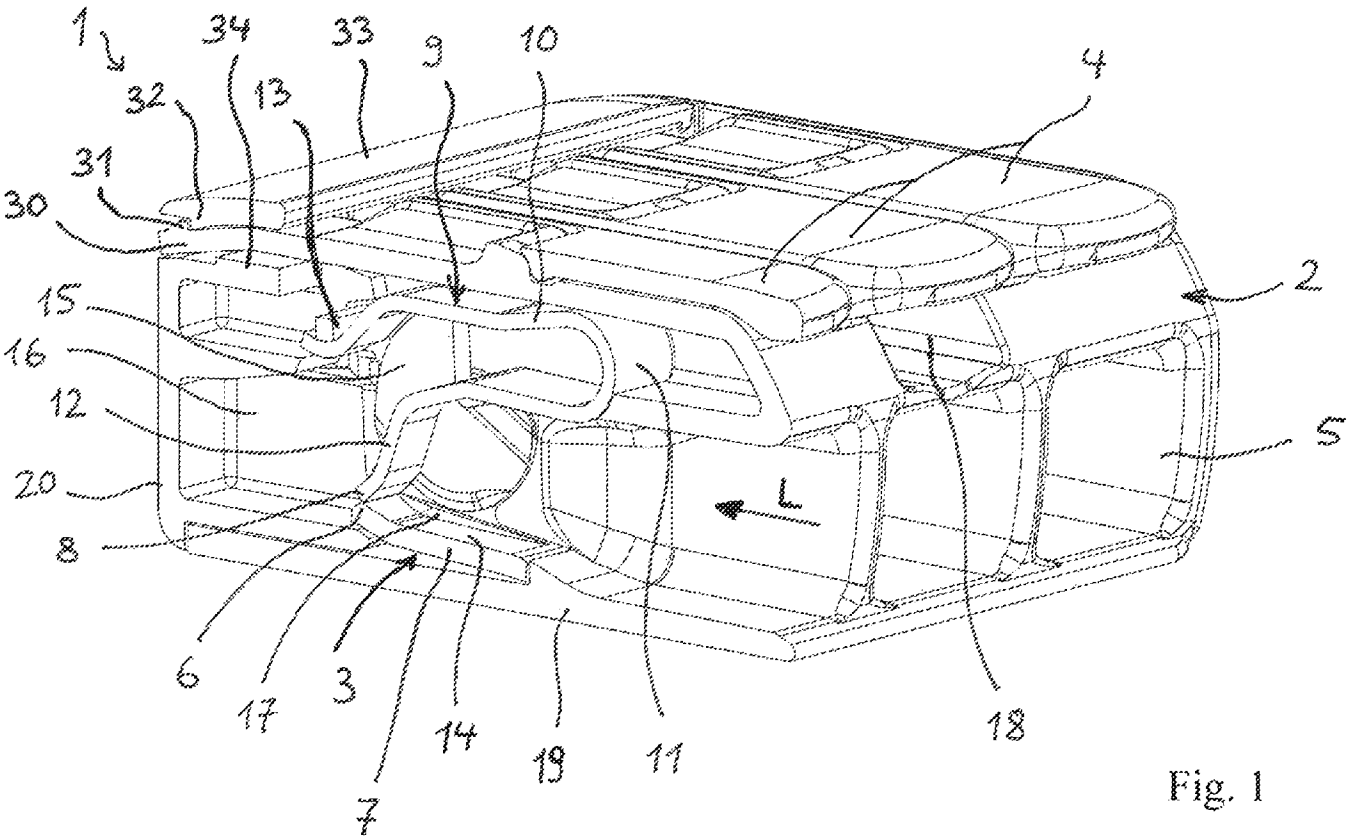
FIG. 1 is a perspective sectioned view of a connection terminal.

FIG. 1 is a perspective sectioned view of a connection terminal 1 which has an insulating material housing 2 and a spring-loaded terminal contact 3 integrated therein. Furthermore, pivotably supported actuation levers 4 are integrated in the insulating material housing 2. The insulating material housing 2 has a plurality of conductor introduction openings 5 which are arranged beside each other and which extend parallel with each other and which lead to a terminal location for clamping an electrical conductor which is inserted in the conductor insertion direction L. The clamping location is formed by means of a clamping edge 6 of a busbar 7 which extends transversely relative to the conductor insertion direction and a resilient clamping edge 8 of a respective clamping spring 9. The clamping spring 9 is constructed as a leg spring and has an abutment member 10, a curved resilient member 11 which is adjacent thereto and a clamping member 12 opposite the abutment member 10. The curved resilient member 11 consequently connects the abutment member 10 and the clamping member 12 to each other. It is evident that the clamping member 12 optionally after a plurality of bending portions has the resilient clamping edge 8 at the free end and extends as far as the plane of the busbar 7.

It can further be seen that the abutment member 10 of the clamping spring 9 is suspended in a retention flap 13 which is connected to the busbar 7 and supported at that location. Consequently, a self-supporting spring-loaded terminal contact 3 is produced in which the forces which occur when an electrical conductor is clamped using the clamping force of the clamping spring 9 are transmitted to the insulating material housing 2 only in an insignificant manner.

At the upper side of the busbar 3 which faces the clamping spring 9 and in particular the clamping member 12, there is introduced a groove-like recess 14 which is arranged when viewed in the conductor insertion direction L upstream of the clamping location and the clamping edge 6 of the busbar 3. The groove-like recess extends in this instance in the conductor insertion direction L parallel with the extent direction of the abutment member 10 and the clamping member 12, which direction is illustrated in the busbar plane. As a result of the groove-like recess 14, the clamping edge 6 when viewed in the conductor insertion direction L is released upstream of the clamping edge 6. The groove-like recess 14 with the side walls 17 thereof additionally provides an introduction channel for the free end of an electrical conductor which is intended to be clamped.

It can further be seen that the actuation levers 4 are pivotably supported with a part-circular bearing portion 15 adjacent to the clamping spring 9 in the insulating material housing 2. The part-circular bearing portion 15 is in this instance supported and guided on the outer periphery thereof in the insulating material housing. The conductor introduction opening 5 merges in this instance into the part-circular bearing portion 15 whose outer side also forms a portion of the conductor introduction opening 5 and leads an electrical conductor to the clamping location and into a conductor receiving pocket 16 which is provided behind the clamping location in the insulating material housing 2.

It can further be seen that the groove-like recess 14 merges with the side wall 17 thereof into the face of the part-circular bearing portion 15. The part-circular bearing portion 15 is arranged adjacent to the groove-like recess 14.

Optionally, the insulating material housing 2 has at the front side adjacent to a conductor introduction opening 5 an examination opening 18 which leads to the spring-loaded terminal contact 3. Consequently, using a testing pin which is introduced into the examination opening 18, it is possible to measure whether there is electrical potential at the spring-loaded terminal contact 3.

It can further be seen that the insulating material housing 2 is constructed in two parts with a base member 19 and a rear catch cover 20. The base member 19 has the conductor introduction openings 5. With the catch cover 20 open, the spring-loaded terminal contact 3 and the actuation levers 4 are inserted into the base member 19. Subsequently, the base member 19 is closed with the catch cover 20 at the rear side diagonally opposite the conductor introduction openings 5. In this instance, the catch cover 20 is engaged on the base member 19 using suitable catch elements.

In the upper rear region of the insulating material housing 2, the catch cover 20 engages with the base member 19 using at least one resilient catch arm 30 which is formed from insulating material and which extends in the conductor insertion direction L and adjoins the upper covering plate of the base member 19 in an integral manner. In the unloaded state, the resilient catch arm 30 is planar per se and not as illustrated bent over in the direction toward the free end. At the free end of the at least one catch arm 30 there protrudes a catch projection or a catch web 31 which cooperates and engages with a corresponding stop 32 on a transverse web 33 of the catch cover 20.

It can be seen that the catch cover 20 with a spacing opposite the transverse web 33 has a raised web 34 such that the at least one catch arm 30 is guided between the raised web 34 and the transverse web 33 and is then redirected downward away from the transverse web 33 by the stop 32 which is located behind the raised web 34 and which extends in the direction of the portion of the catch cover 20 which carries the raised web 34. The at least one resilient arm 31 is thereby bent at the free end region so that the catch projection 31 is securely retained by the flexible resilience of the resilient arm 30 behind the stop 32. Using the upstream raised web 34, it is consequently possible for the resilient arm 30 to be tensioned in the catch position on the transverse web 33.

Figure 2:
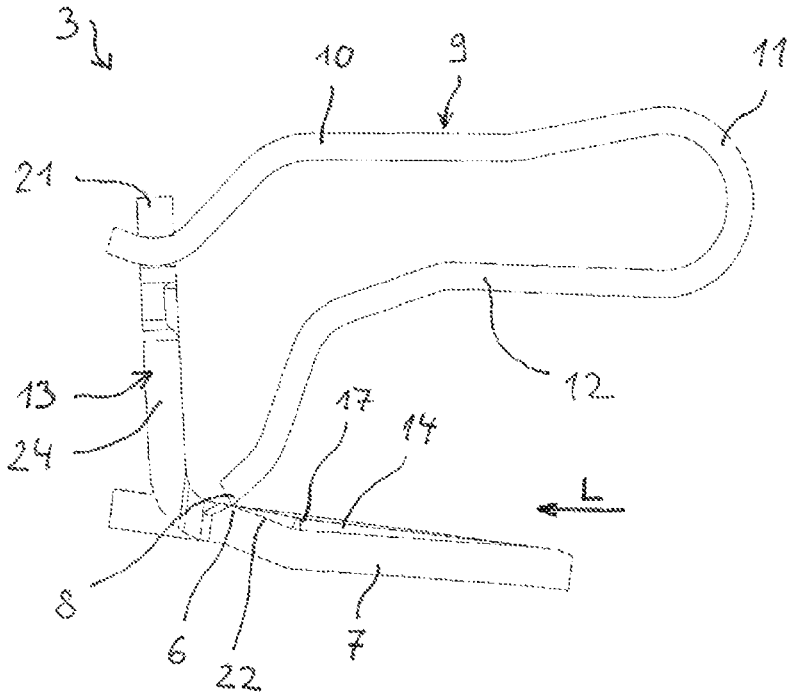
FIG. 2 is a lateral sectioned view of the spring-loaded terminal contact of the connection terminal from FIG. 1.

FIG. 2 is a lateral sectioned view of the spring-loaded terminal contact 3 for the connection terminal 1 from FIG. 1. This spring-loaded terminal contact 3 forms a contact insert and has a busbar 7 from which retention flaps 13 which are formed integrally with the busbar 7 protrude. It can be seen that the abutment member 10 of the clamping spring 9 is suspended in a transverse web 21 of the retention flaps 13.

It can be seen that, from the surface of the busbar 7 which faces toward the clamping spring 9, a groove-like recess 14 is stamped. This groove-like recess 14 is in this instance coined in such a manner that in the region of the groove-like recess 14 a portion of the material of the busbar 7 is pressed out from the lower plane of the busbar 7. The groove-like recess 14 has side walls 17 and an inclined face 22 which extends in the direction toward the clamping edge 6.

Figure 3:
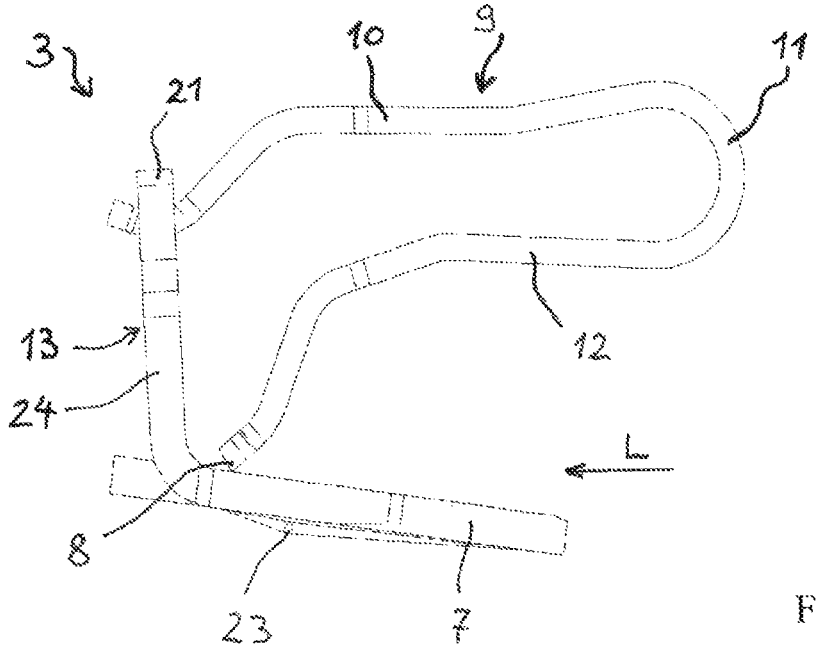
FIG. 3 is a side view of the spring-loaded terminal contact from FIG. 2.

FIG. 3 shows a side view of the spring-loaded terminal contact 3 from FIG. 2. In this instance, it can be seen that the groove-like recess 14 is stamped from the upper side of the busbar 7 which faces the clamping spring 9 with a material portion 23 which protrudes below the lower busbar plane being formed. It can further be seen that the retention web 13 is bent away in an upward direction from the busbar plane of the busbar 7, wherein the retention flap 13 has two lateral webs 24 which are connected to each other with the upper transverse web 21. In this manner, a conductor through-opening is formed in the retention flap 13 and the abutment member 10 can be suspended below the transverse web 21 in the retention flap 13.

Figure 4:
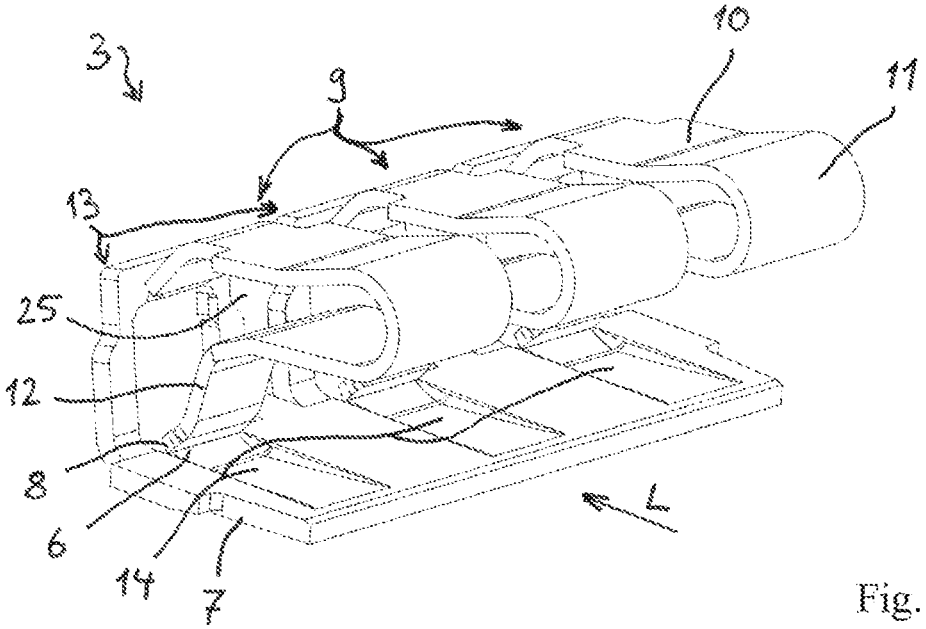
FIG. 4 is a perspective view of the spring-loaded terminal contact from FIGS. 2 and 3.

FIG. 4 is a perspective view of the spring-loaded terminal contact 3 from FIG. 3. In this instance, it can be seen that the busbar 7 extends transversely relative to the conductor insertion direction L and a plurality of groove-like recesses 14 are arranged beside each other. In this instance, the groove-like recesses 14 extend in the conductor insertion direction L, wherein a clamping spring 9 is associated with each groove-like recess 14.

In this manner, a plurality of clamping locations for electrical conductors are provided beside each other, wherein the electrical conductors can be connected to each other in an electrically conductive manner by means of the common busbar 7.

It can further be seen that, when viewed in the conductor insertion direction L downstream of the respective clamping location which is formed by a spring clamping edge 8 of the associated clamping spring 9 and the clamping edge 6 of the busbar 7, for each clamping spring 9 a retention flap 13 is bent from the busbar 7. The retention flaps 13 are in this instance arranged spaced apart from each other with an intermediate space 25 being formed.

It can further be seen that the clamping springs in the region of the clamping edge 8 of the clamping member 12 have a width which substantially corresponds to the width of the associated groove-like recess 14 (±10%).

Figure 5:
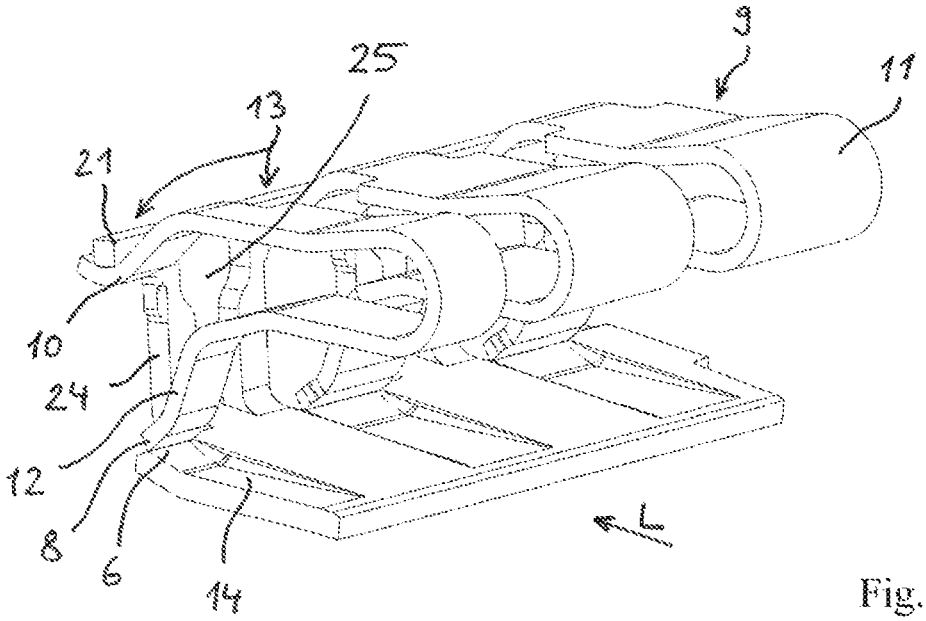
FIG. 5 is a perspective sectioned view of the spring-loaded terminal contact from FIG. 4.

FIG. 5 is a perspective sectioned side view of the spring-loaded terminal connection from FIG. 4. In this instance, it can be seen that the abutment member 10 is suspended with a bending portion on the free end below the transverse web 21 of the associated retention flap 13.

Figure 6:
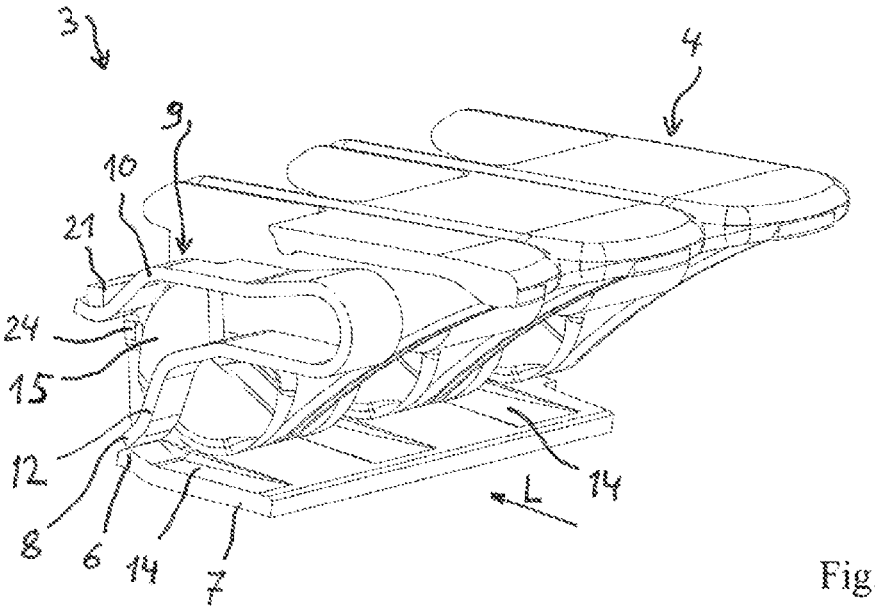
FIG. 6 is a perspective sectioned view of the spring-loaded terminal contact from FIG. 4 with an actuation lever.

FIG. 6 is a perspective sectioned view of the spring-loaded terminal connection 3 from FIG. 5. In this instance, actuation levers 4 are additionally arranged in the intermediate space between two adjacent clamping springs 9. It can be seen in this instance that the part-circular bearing portion 15 of the pivotably supported actuation levers is supported on the upper side of the busbar 7 directly adjacent to the groove-like recess 14. In this instance, a separate actuation lever 4 is provided for each clamping spring 9.

Figure 7:
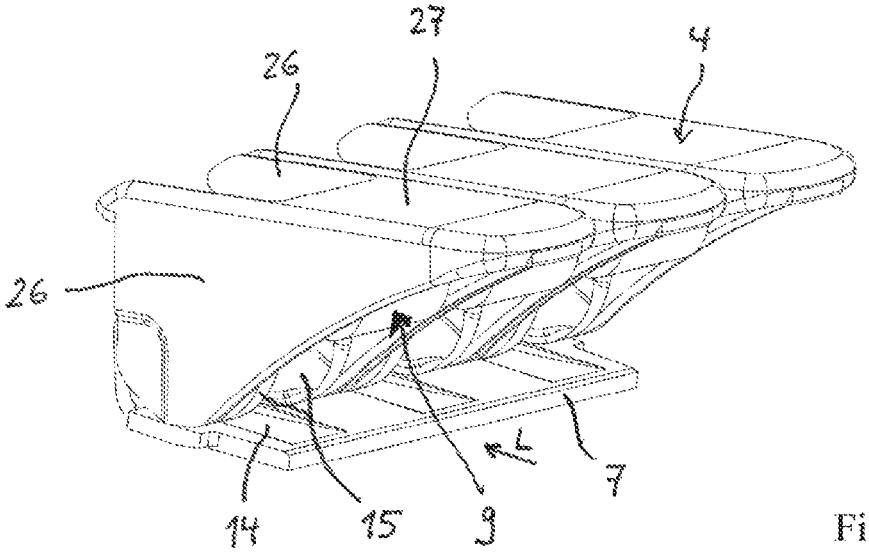
FIG. 7 is a perspective view of the spring-loaded terminal contact from FIG. 5 with an actuation lever.

FIG. 7 is a perspective view of the spring-loaded terminal connection 3 from FIG. 6. It can be seen that the actuation levers 4 each have two part-circular bearing portions 15 which are spaced apart from each other by the intermediate groove-like recess 14 and which a respective arm portion 26 adjoins. At the upper side, the arm portions 26 are connected to each other by a transverse plate 27. The associated clamping spring 9 is in this instance introduced in the space which is surrounded by the arm portions 26 and the transverse plate 27. The actuation levers 4 are in this manner constructed in a very stable and space-saving manner and contribute with the part-circular bearing portions 15 to guiding the electrical conductor.

The invention claimed is:

1. A spring-loaded terminal contact for contacting electrical conductors comprising:

at least one busbar having a clamping edge; and at least one clamping spring having:

an abutment member, a clamping member extending in a direction toward the busbar and having a resilient clamping edge for clamping an electrical conductor introduced between the clamping member and the busbar in a conductor insertion direction (L), and a curved resilient member arranged between the abutment member and the clamping member, wherein the clamping edge of the busbar and the resilient clamping edge of the clamping member together form a clamping location for an electrical conductor to be clamped; and wherein the busbar has a groove-like recess in the conductor insertion direction (L) upstream of the clamping location adjacent to the clamping edge, with the clamping edge extending transversely to the conductor insertion direction and forming the front end of the groove-like recess.

2. The spring-loaded terminal contact as claimed in claim 1, characterized in that the busbar extends transversely relative to the conductor insertion direction (L) and a plurality of groove-like recesses which extend parallel with each other are arranged beside each other on the busbar, wherein a clamping spring is associated with each groove-like recess.

3. The spring-loaded terminal contact as claimed in claim 1, characterized in that the groove-like recess is stamped in the busbar.

4. The spring-loaded terminal contact as claimed in claim 3, characterized in that the groove-like recess is coined or embossed.

5. The spring-loaded terminal contact as claimed in claim 1, characterized in that there is arranged in the conductor insertion direction (L) downstream of the clamping location a retention flap which extends away from the busbar plane, wherein the clamping spring is suspended in the retention flap with the abutment member thereof with spacing from the busbar plane.

6. The spring-loaded terminal contact as claimed in claim 5, characterized in that the retention flap is constructed integrally with the busbar.

7. The spring-loaded terminal contact as claimed in claim 5, characterized in that the retention flap is constructed as a component which is separate from the busbar.

8. The spring-loaded terminal contact as claimed in claim 5, characterized in that the busbar extends transversely relative to the conductor insertion direction (L) and a plurality of groove-like recesses which extend parallel with each other are arranged beside each other on the busbar, wherein a clamping spring is associated with each groove-like recess and wherein a retention flap is provided for each clamping spring, respectively, and the retention flaps are arranged spaced apart from each other with an intermediate space being formed.

9. A connection terminal for electrical conductors having an insulating material housing which has at least one conductor introduction opening for introducing an electrical conductor, characterized in that at least one spring-loaded terminal contact as claimed in claim 1 is integrated in the insulating material housing.

10. The connection terminal as claimed in claim 9, characterized in that at least one pivotably supported actuation lever is integrated in the insulating material housing, wherein the actuation lever has an actuation portion which cooperates with the clamping member of at least one associated clamping spring in order to open the clamping location when the actuation lever is pivoted.

* * * * *